US007717016B2

(12) United States Patent
Lai

(10) Patent No.: US 7,717,016 B2
(45) Date of Patent: May 18, 2010

(54) TOOL HANDLE FOR AN EXCHANGEABLE SCREWDRIVER

(76) Inventor: Jin-Tsai Lai, 12F-4 No.666, Sec2, Wuquan W.Rd., Nantun District Taichung, Taichung City (TW) 40878

( * ) Notice: Subject to any disclaimer, the term of this patent is extended or adjusted under 35 U.S.C. 154(b) by 0 days.

(21) Appl. No.: 12/256,468

(22) Filed: Oct. 22, 2008

(65) Prior Publication Data

US 2010/0095812 A1 Apr. 22, 2010

(51) Int. Cl.
*B25B 23/16* (2006.01)
*B25B 23/00* (2006.01)

(52) U.S. Cl. ..... 81/177.1; 81/438; 81/177.8

(58) Field of Classification Search ..... 81/177.1, 81/438, 439, 177.2, 177.85, 489
See application file for complete search history.

(56) References Cited

U.S. PATENT DOCUMENTS 2,378,775 A * 6/1945 Johnson ..... 81/438
5,481,949 A * 1/1996 Yen ..... 81/438
5,881,614 A * 3/1999 Cheng-Tsan ..... 81/438
6,901,826 B2 * 6/2005 Huang ..... 81/177.2
7,458,296 B2 * 12/2008 Richter et al. ..... 81/438
7,467,575 B2 * 12/2008 Lai ..... 81/177.1
2008/0087142 A1 * 4/2008 Lin ..... 81/177.1

* cited by examiner

*Primary Examiner*—Hadi Shakeri

(57) ABSTRACT

A tool handle for an exchangeable screwdriver includes a handle, a retaining unit and a control unit. The retaining unit is mounted in one end of the handle. The retaining unit has a retaining hole defined therein and extending therethrough. The retaining unit has a recess defined in a lateral thereof and communicated with the retaining hole. The retaining unit has at least one connecting portion disposed between the recess and the retaining hole. The control unit is received in the recess. The control unit has at least one resilient arm extending therefrom. The at least one resilient arm passes the recess and is abutted against the at least one connecting portion to selectively extend to the retaining hole.

4 Claims, 5 Drawing Sheets

TOOL HANDLE FOR AN EXCHANGEABLE SCREWDRIVER

BACKGROUND OF THE INVENTION

1. Field of the Invention

The present invention relates to a tool handle, and more particularly to a tool handle for an exchangeable screwdriver.

2. Description of Related Art

A conventional exchangeable screwdriver in accordance with the prior art comprises a tool handle and a tool shank. The tool handle has an open cavity for receiving one end of the tool shank. The other end of the tool shank is an actuating portion for actuating a screw. The middle of the tool shank has two projections symmetrically extending therefrom. The tool handle has two slots symmetrically extending from the cavity for engaging the middle of the tool shank. Therefore the tool shank is retained to prevent rotation relative to the tool handle. The tool shank is free to be detached from the tool handle to change the different tool shank. The conventional tool handle does not avoid the axial movement of the tool shank. When operating the conventional exchangeable screwdriver, the tool shank is possible to slide out. It is inconvenient for usage and maybe dangerous for the user.

The present invention has arisen to mitigate and/or obviate the disadvantages of the conventional tool handle.

SUMMARY OF THE INVENTION

The main objective of the present invention is to provide an improved tool handle for an exchangeable screwdriver, which prevents the tool shank from axial movement and permits the tool shank detaching from the tool handle easily and quickly.

To achieve the objective, the tool handle includes a handle, a retaining unit connected to the handle and a control unit connected to the retaining unit. The handle has a mounting portion formed in one end thereof. The retaining unit is mounted in the mounting portion. The retaining unit has a retaining hole defined therein and extending therethrough. The retaining unit has a recess defined in a lateral thereof and communicated with the retaining hole. The retaining unit has at least one connecting portion disposed between the recess and the retaining hole. The control unit is received in the recess. The control unit has at least one resilient arm extending therefrom. The at least one resilient arm passes the recess and is abutted against the at least one connecting portion to selectively extend to the retaining hole.

Further benefits and advantages of the present invention will become apparent after a careful reading of the detailed description with appropriate reference to the accompanying drawings.

DETAILED DESCRIPTION OF THE INVENTION

Figure 1:
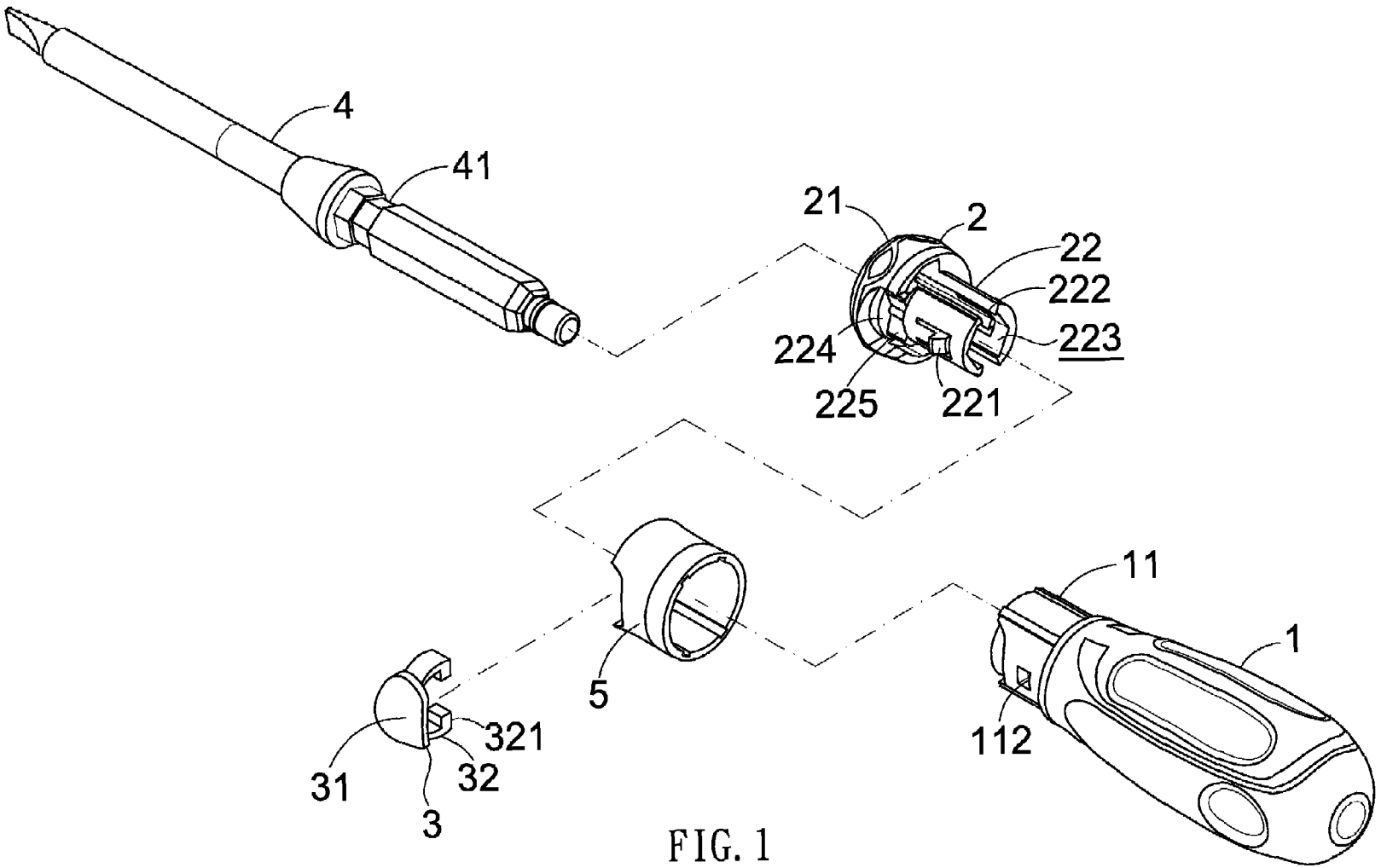
FIG. 1 is an exploded perspective view of a tool handle for an exchangeable screwdriver in accordance with the present invention.
Figures 2, 3:
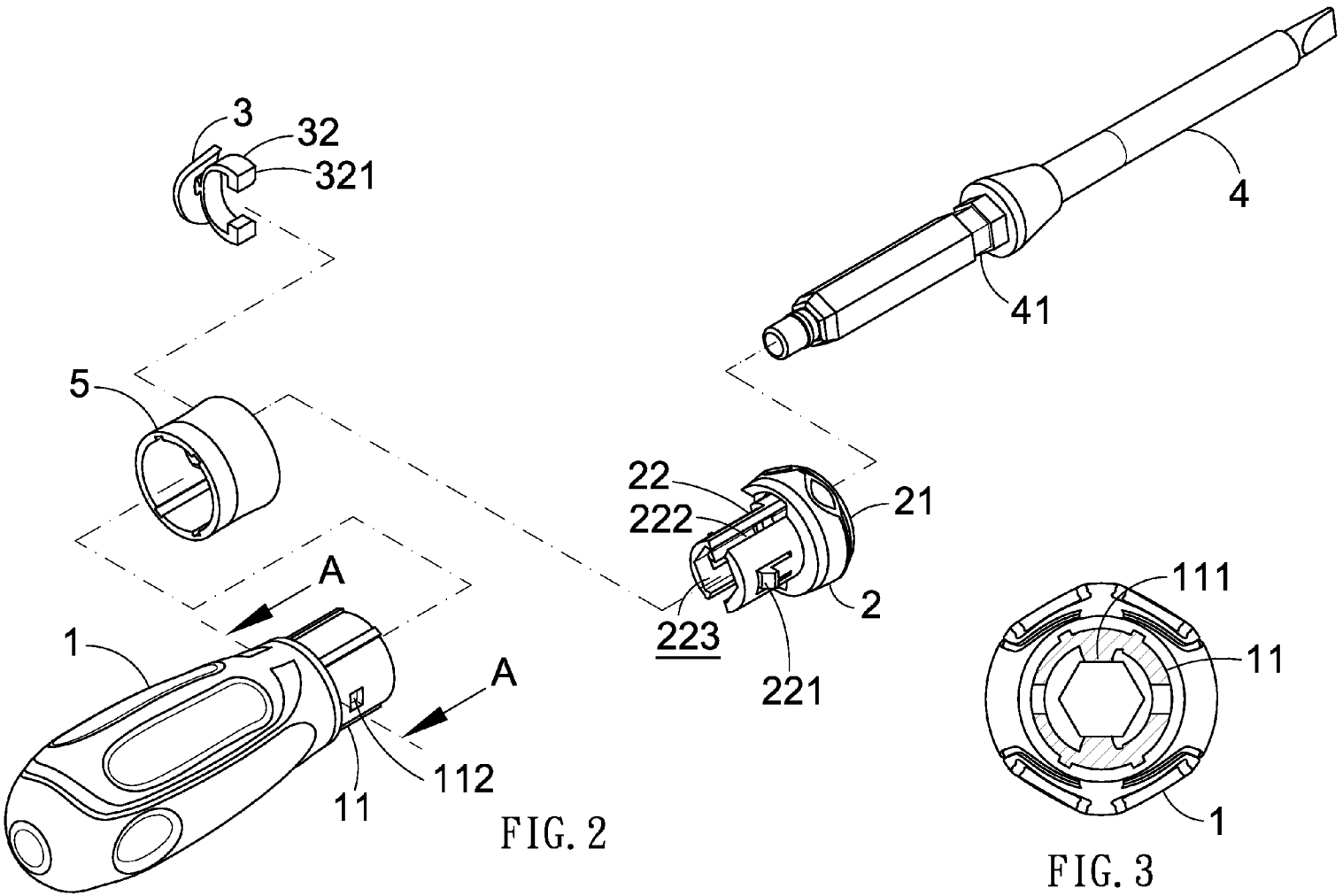
FIG. 2 is another exploded perspective view of the tool handle for an exchangeable screwdriver in accordance with the present invention.
FIG. 3 is a cross-sectional view of the tool handle taken along line A-A in FIG. 2.
Figure 4:
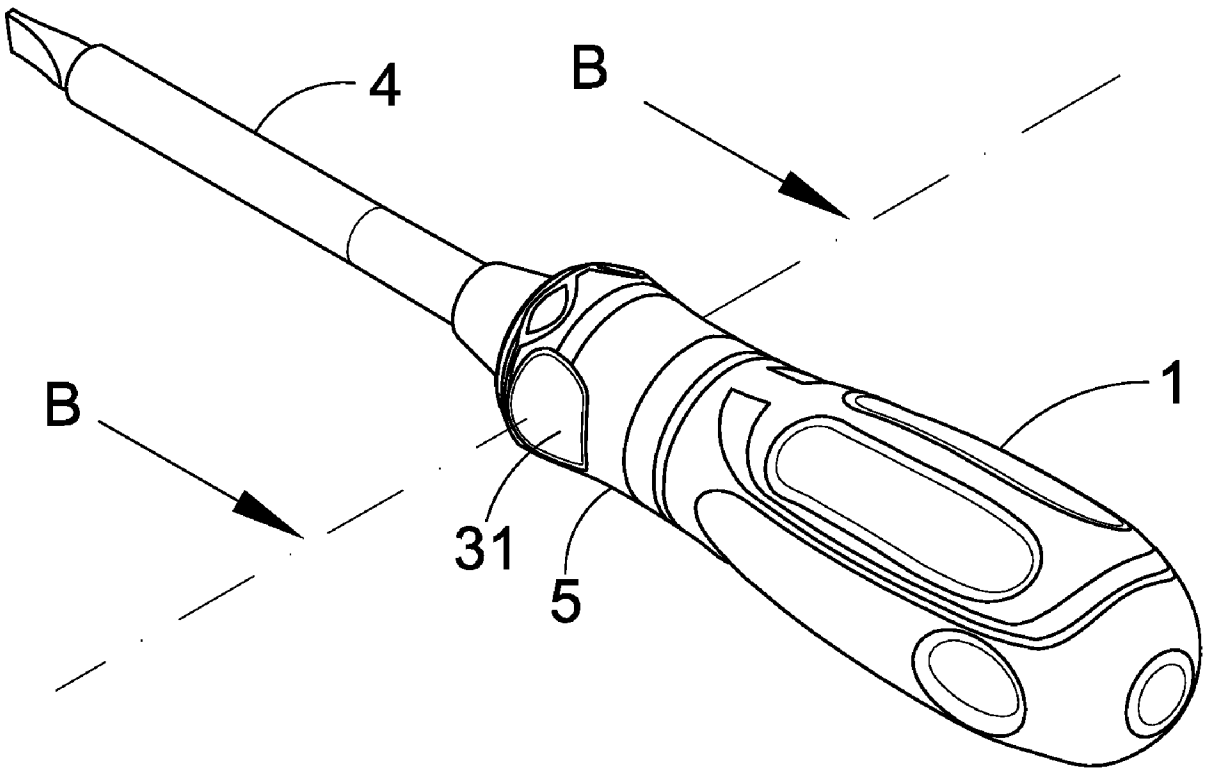
FIG. 4 is an assembly perspective view of the tool handle for an exchangeable screwdriver in FIG. 1.

Referring to the drawings and initially to FIGS. 1-4, a tool handle for an exchangeable screwdriver in accordance with the present invention comprises a handle 1, a retaining unit 2 connected to the handle 1, and a control unit 3 connected to the retaining unit 2.

The handle 1 has a mounting portion 11 formed in one end thereof. The other end of the handle 1 is provided to be gripped by user's hand. The mounting portion 11 is open and hollow. The mounting portion 11 has at least one rib 111 extending from an inner peripheral thereof. In the preferred embodiment, the mounting portion 11 has two ribs 111 symmetrical to each other. The mounting portion 11 has at least one aperture 112 defined in an outer peripheral thereof and extending therethrough. In the preferred embodiment, the mounting portion 11 has two apertures 112 symmetrical to each other.

The retaining unit 2 has a cap 21 formed in one end thereof and a cylinder 22 extending from the cap 21. The cylinder 22 has at least one slot 222 defined in an outer peripheral thereof and at least one hook 221 extending from the outer peripheral thereof. In the preferred embodiment, the cylinder 22 has two slots 222 symmetrical to each other and two hooks 221 symmetrical to each other. The cylinder 22 is inserted in the mounting portion 11. The at least one rib 111 of the mounting portion 11 engages with the at least one slot 222 in the cylinder 22 and the at least one hook 221 of the cylinder 22 engages with the at least one aperture 112 in the mounting portion 11 to prevent the retaining unit 2 from rotating and moving along an axial direction. The retaining unit 2 has a retaining hole 223 defined in a center of the cylinder 22 and extending through the cylinder 22 and the cap 21 to complementarily receive a tool shank 4. The retaining hole 223 has a noncircular section. In the preferred embodiment, the retaining hole 223 has a hexagonal section and the tool shank 4 has a hexagonal section. The tool shank 4 is complementarily received in the retaining hole 223 to prevent from rotation. The cap 21 has a recess 224 defined in a lateral thereof and communicated with the retaining hole 223. The retaining unit 2 has at least one connecting portion 225 disposed between the recess 224 and the retaining hole 223 to connect the cap 21 and the cylinder 22. In the preferred embodiment, the retaining unit 2 has two connecting portions 225.

Figure 5:
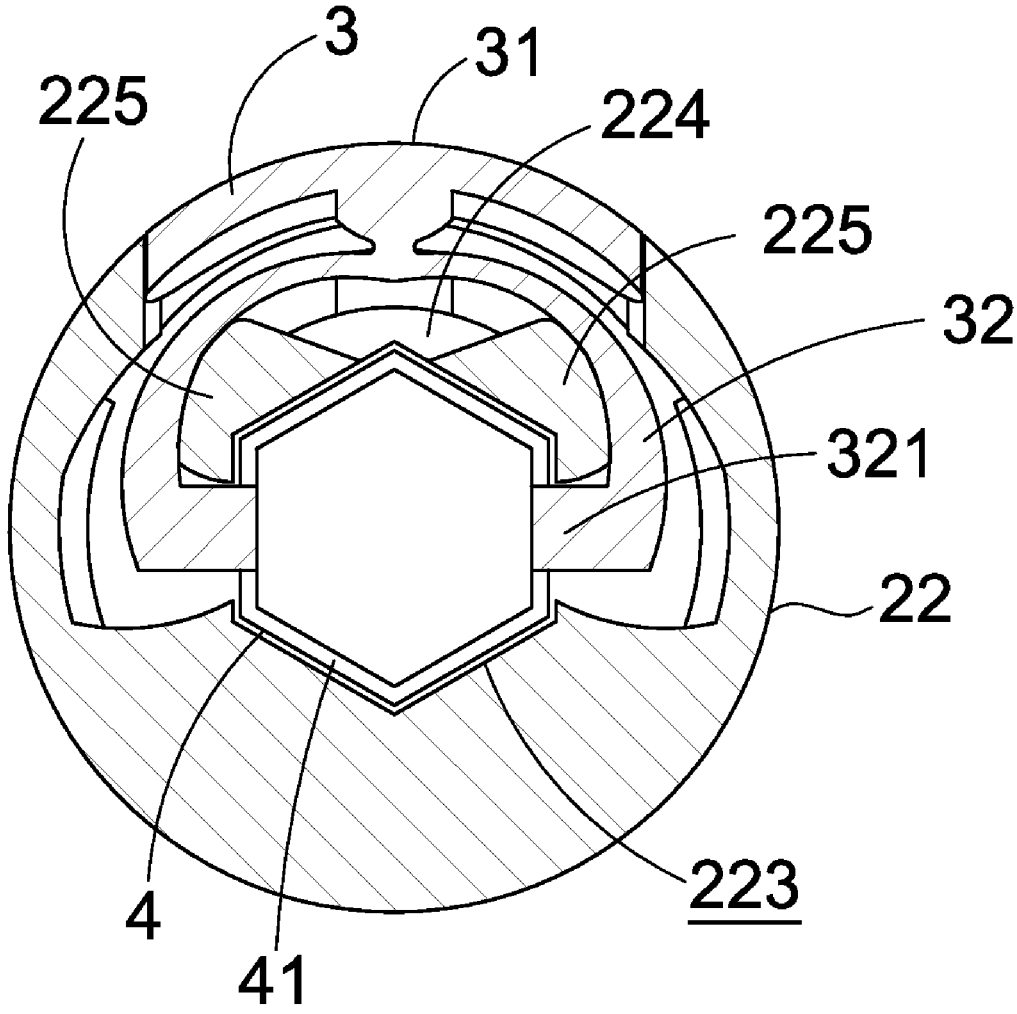
FIG. 5 is a cross-sectional view of the tool handle for an exchangeable screwdriver taken along line B-B in FIG. 4.
Figure 6:
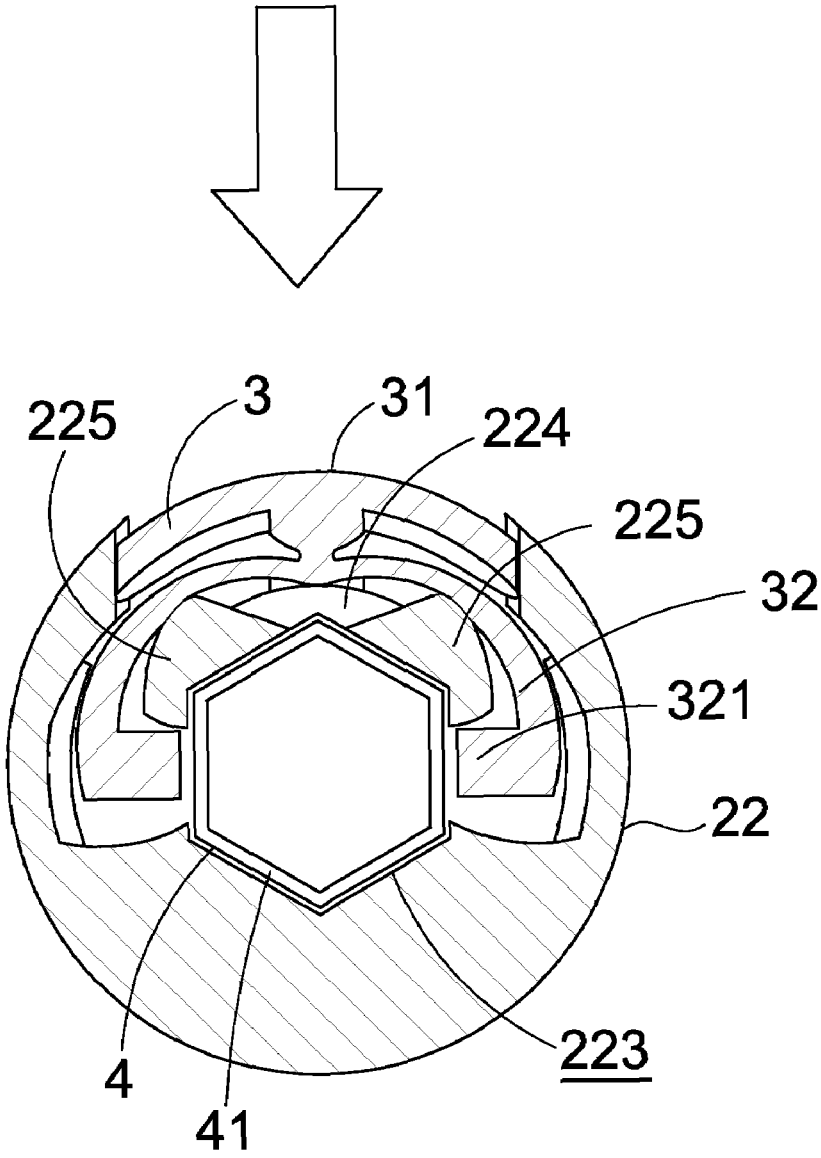
FIG. 6 shows the operation of the control unit of the tool handle for an exchangeable screwdriver in accordance with the present invention.

The control unit 3 has a press surface 31 formed in one end thereof. The press surface 31 is in a shape of camber. The control unit 3 has at least one resilient arm 32 curvilinearly extending from the other end thereof. In the preferred embodiment, the control unit 3 has two resilient arms 32 to form a semicircle. Each resilient arm 32 has an extending catch 321 extending from a free end thereof. The control unit 3 is received in the recess 224. The press surface 31 fits the cap 21 to conceal the control unit 3. The two resilient arms 32 passes the recess 224 and respectively abuts against the two connecting portions 225. Each extending catch 321 extends into the retaining hole 223 as shown in FIG. 5. The tool shank 4 has an annular groove 41 defined in an outer peripheral thereof. When inserting the tool shank 4 into the retaining hole 223, the two extending catches 321 engage with the annular groove 41 to prevent the tool shank 4 from axial movement. When pressing the press surface 31, the two resilient arms 32 respectively pivot on the two connecting portions 225 to retract the extending catches 321 as shown in FIG. 6. Therefore, each extending catch 321 disengages with the annular groove 41 such that the tool shank 4 is free to be detached from the handle 1.

The tool handle in accordance with the present invention further comprises a sleeve 5 disposed in an outer peripheral of the mounting portion 11 to avoid disengaging the at least one hook 221 unconsciously and prevent the retaining unit 2 from dust and moisture.

Although the invention has been explained in relation to its preferred embodiment, it is to be understood that many other possible modifications and variations can be made without departing from the spirit and scope of the invention as hereinafter claimed.

What is claimed is:

1. A tool handle for an exchangeable screwdriver comprising:

a handle having a mounting portion formed in one end thereof, the mounting portion having at least one aperture defined in an outer peripheral thereof;

a retaining unit mounted in the mounting portion; the retaining unit having at least one hook extending from an outer peripheral thereof, the at least one hook engaged with the at least one aperture in the mounting portion to prevent the retaining unit from rotation and axial movement, the retaining unit having a retaining hole defined therein and extending therethrough, the retaining unit having a recess defined in a lateral thereof and communicated with the retaining hole; the retaining unit having two connecting portion disposed between the recess and the retaining hole;

a sleeve disposed on the peripheral of the mounting portion to avoid disengaging the at least one hook; and a control unit received in the recess; the control unit having two resilient arms curvilinearly extending therefrom to form a semicircle, the two resilient arms passing the recess and respectively abutted against the two connecting portion to selectively extend to the retaining hole, each resilient arm having an extending catch extending from a free end thereof for selectively extend to the retaining hole.

2. The tool handle for an exchangeable screwdriver as claimed in claim 1, wherein the mounting portion has at least one rib extending from an inner peripheral thereof and the retaining unit has at least one slot defined in the outer peripheral thereof, the at least one rib engaged with the at least one slot to prevent the retaining unit from rotating relative to the handle.

3. The tool handle for an exchangeable screwdriver as claimed in claim 1, wherein the retaining hole has a noncircular section.

4. The tool handle for an exchangeable screwdriver as claimed in claim 1, wherein the retaining hole is in a shape of hexagon.

* * * * *